US006520486B2

(12) United States Patent
Huang

(10) Patent No.: US 6,520,486 B2
(45) Date of Patent: Feb. 18, 2003

(54) BRAKING DEVICE FOR MOTIVE WINCH

(76) Inventor: Shih Jyi Huang, No. 19, Alley 6, Lane 325, Chien Kang Road, Taipei (TW)

( * ) Notice: Subject to any disclaimer, the term of this patent is extended or adjusted under 35 U.S.C. 154(b) by 0 days.

(21) Appl. No.: 09/894,005

(22) Filed: Jun. 29, 2001

(65) Prior Publication Data

US 2003/0001148 A1 Jan. 2, 2003

(51) Int. Cl.[7] ..... B66D 5/02
(52) U.S. Cl. ..... 254/347; 254/375
(58) Field of Search ..... 254/375, 378, 254/347, 356, 366

(56) References Cited

U.S. PATENT DOCUMENTS

| | | | | | |
|---|---|---|---|---|---|
| 4,046,235 | A | * | 9/1977 | Shutt | 254/356 |
| 4,390,161 | A | * | 6/1983 | Nelson | 254/356 |
| 4,461,460 | A | * | 7/1984 | Telford | 254/378 |
| 4,545,567 | A | * | 10/1985 | Telford et al. | 254/378 |
| 5,261,646 | A | * | 11/1993 | Telford | 254/375 |
| 5,398,923 | A | * | 3/1995 | Perry et al. | 254/375 |
| RE36,216 | E | * | 6/1999 | Telford | 254/375 |

FOREIGN PATENT DOCUMENTS

| | | | | | |
|---|---|---|---|---|---|
| JP | 405124795 | A | * | 5/1993 | 254/378 |

* cited by examiner

*Primary Examiner*—Kathy Matecki
*Assistant Examiner*—Sang Kim
(74) *Attorney, Agent, or Firm*—Bacon & Thomas, PLLC

(57) ABSTRACT

The present invention discloses a braking device for a motive winch, mainly having a sectional axle, an elastic member, two engraved chunks, and a clutch base in a retardation compartment of the motive winch; wherein said first engraved chunk is coupled to the sectional axle, having a braking plate being contacted with the frictional surface in the retardation compartment; the elastic member has an appropriate whirling force with respect to the first engraved chuck such that the braking plate of the first engraved chuck tends to press against the frictional surface of the retardation compartment; the second engraved trunk is coupled to the sectional axle and rotates synchronously, such that the first and second engraved chucks are capable of being attached to each other to push the brake plate of the first engraved trunk to generate the braking action on an inclined surface and the clutch base brings a protruded member to rotate, and the protruded members on the two engraved chunks is pushed by the protruded trunk at the inner side of the clutch base, and the axle of the motor brings the mechanical force for the clutch base. Such arrangement can stop the braking action by bringing the two engraved trucks to rotate simultaneously in the clutch base when the motor is operating. When the motive force is stopped, the pulling force due to the reaction of heavy substance comes from the cable wire reel makes the inclined plane of the second engraved trunk to push the inclined plane of the first engraved trunk such that the brake plate and the frictional surface contact with each other tightly, and hence attains the braking effect.

1 Claim, 7 Drawing Sheets

BRAKING DEVICE FOR MOTIVE WINCH

BACKGROUND OF THE INVENTION

1. Field of the Invention

The present invention relates to a braking device for a motive winch, more particularly to a highly reliable and safe innovative structural design of a braking device.

2. Description of the Prior Art

In General, the braking device used for industrial applications was disclosed in the inventor's R.O.C. Patent Application No. 85212474 entitled "Braking device without motive force for crane elevator" filed on Aug. 15, 1996, which was published in the patent bulletin on May 21, 1997 with Publication No. 306588 (which is shown in the attachment). However, the present inventor further improves such device with another innovative design for the braking mechanism.

SUMMARY OF THE INVENTION

The primary objective of the present invention is to provide a braking device for a motive winch, which has a reliable and safe protective design to ensure the operating safety of the users and the equipment in addition to its innovative structural design.

To make it easier for our examiner to understand the objective of the invention, structure, innovative features, and performance, we use a preferred embodiment together with the attached drawings for the detailed description of the invention.

When the braking device of the present invention is in use, it definitely has a safe braking effect because once the motive force disappears, the device will immediately produce a braking effect due to the reaction in the reverse gravitation of the heavy load of the substance on the wheel. Therefore, it is absolutely safe to use such device. When the device according to the present invention is not in use, it is always in the braking status, which the device is a safe mechanical brake and a safe operating environment for a motive force winch. It enhances the traditional braking device and improves the shorting comings of the prior art.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
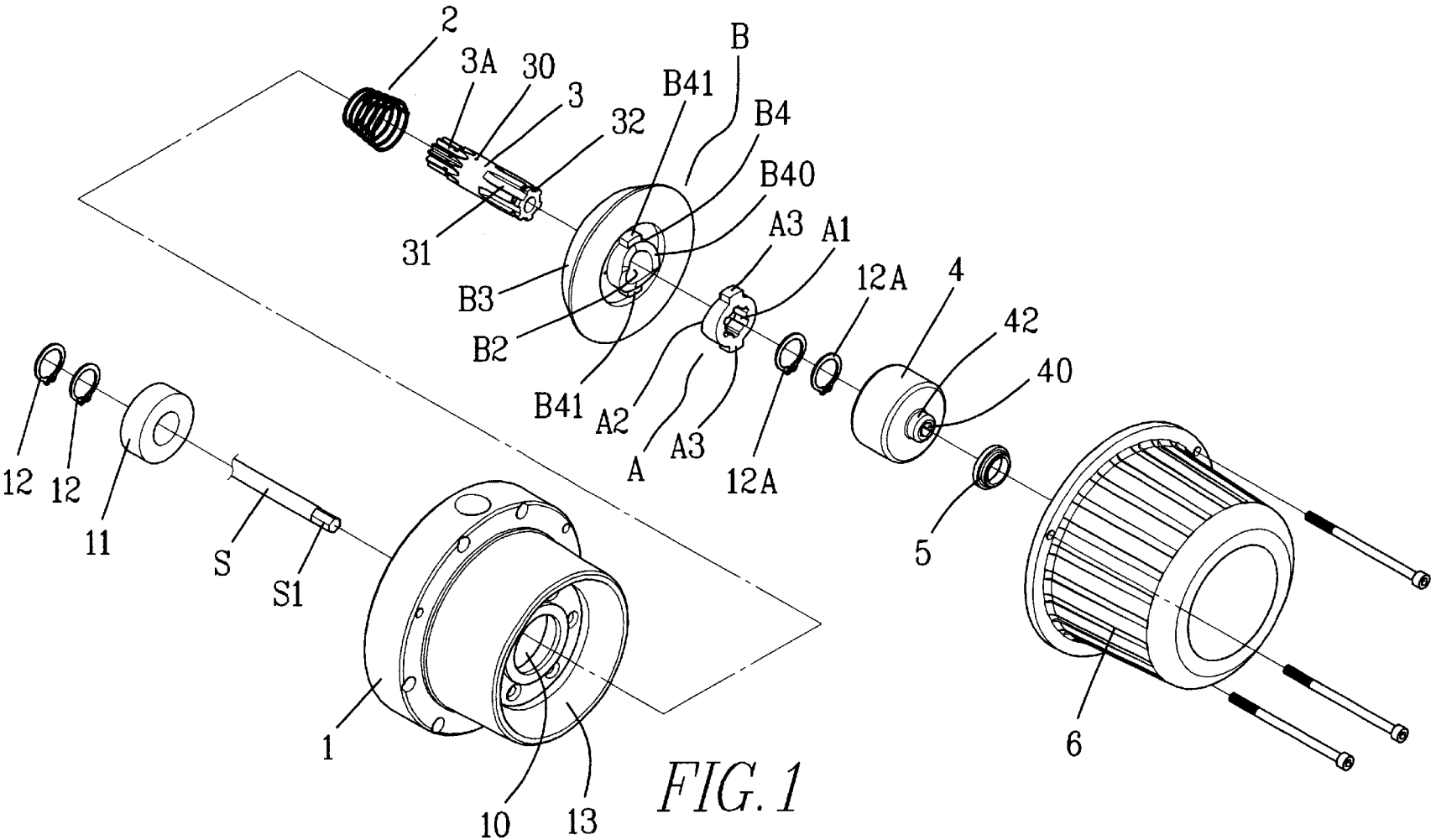
FIG. 1 shows the disassembled parts of a preferred embodiment of the present invention.
Figure 2:
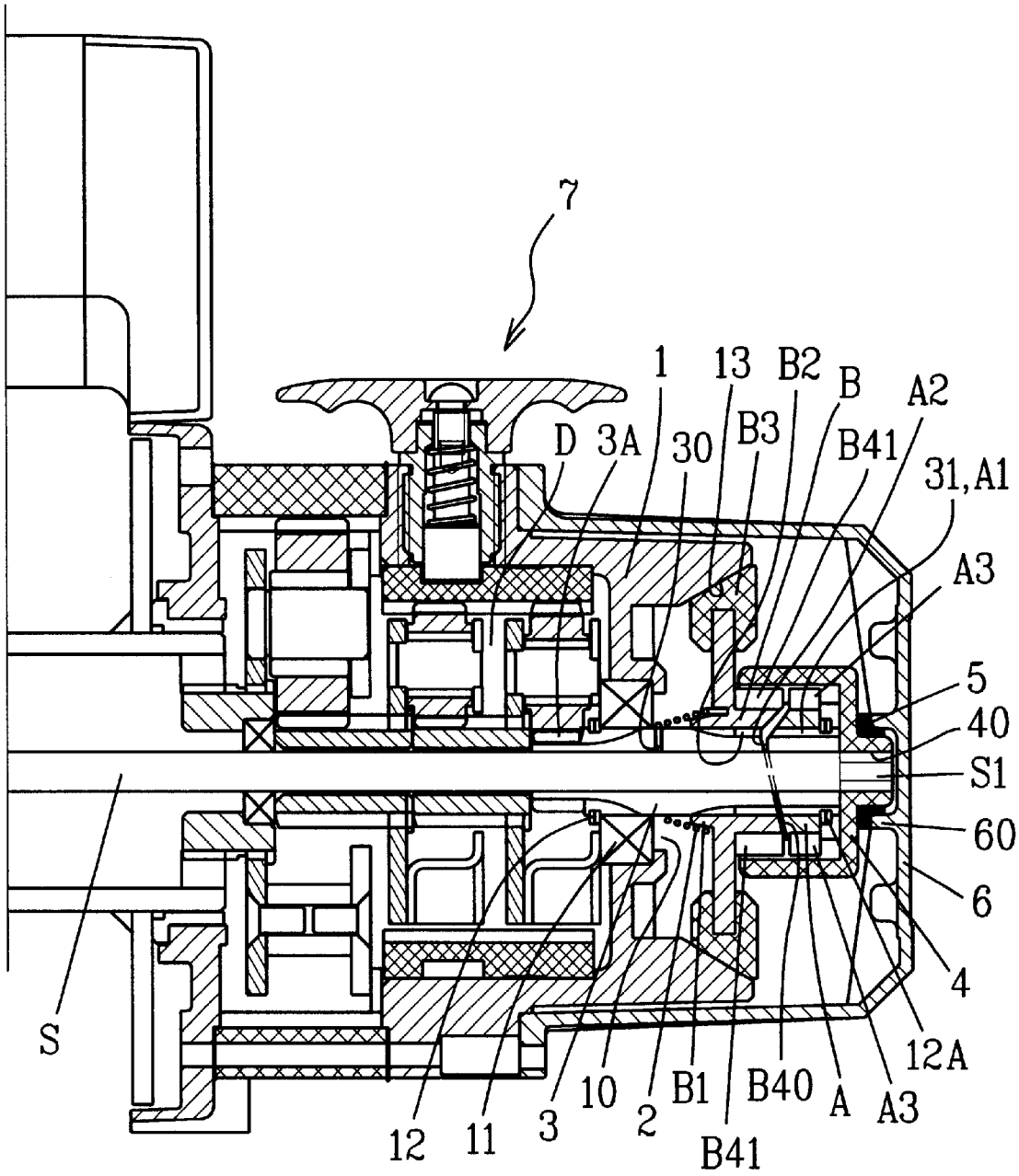
FIG. 2 shows the cross-sectional diagram of the assembled parts of a preferred embodiment of the present invention.
Figure 3:
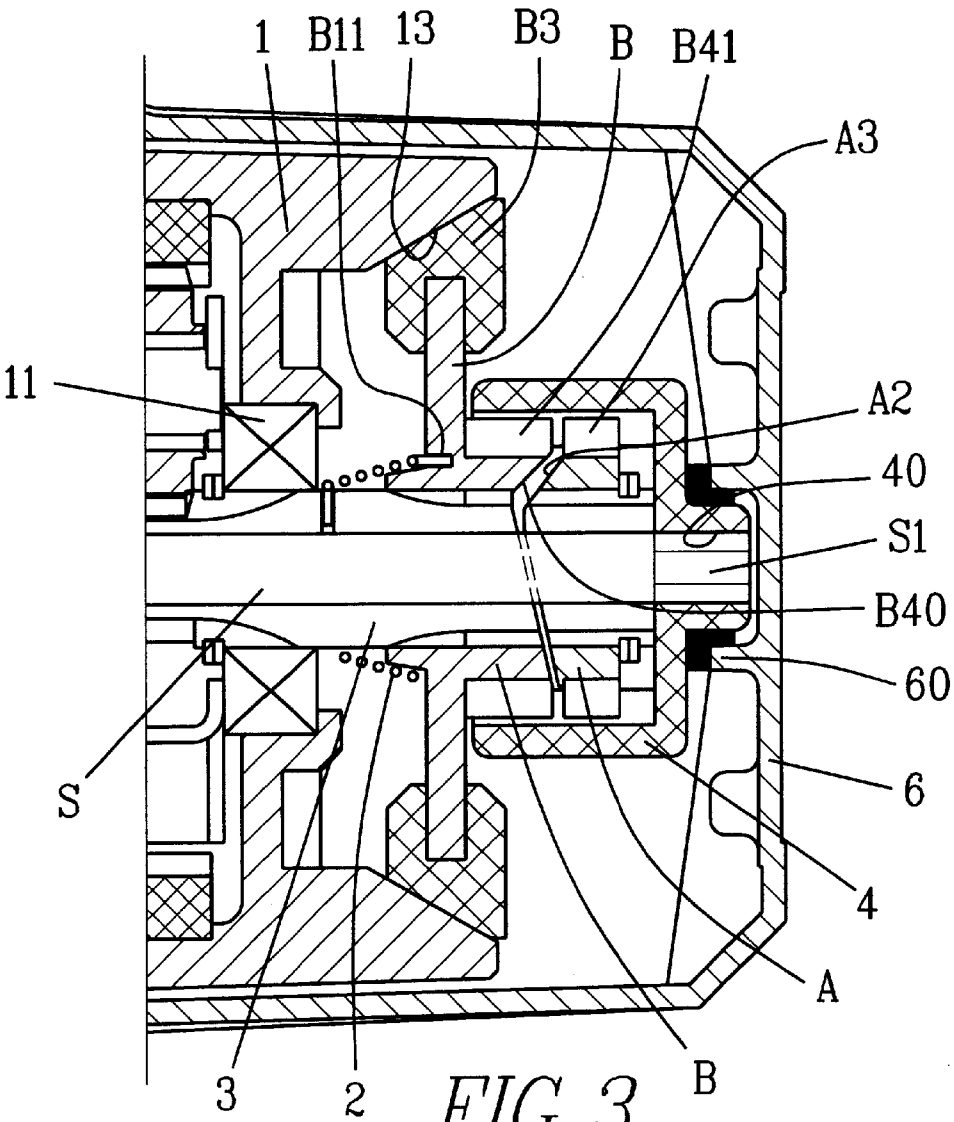
FIG. 3 shows the enlarged cross-sectional diagram of the assembled parts of a preferred embodiment of the present invention.

Please refer to FIGS. 1 and 2, which respectively show the cross-sectional diagrams for the disassembled parts of the braking device for a winch and the assembled structure according to a preferred embodiment of the present invention. The structure comprises:

A retardation compartment 1, being disposed on the motive winch and having a penetrating hole 10 in the middle for allowing a motor axle S to pass through and a sectional axle 3 to extend into it, and a bearing 11 is disposed at the inner side of the penetrating hole 10, and after the sectional axle 3 passes through the bearing 11 and the retardation gear set D is engaged, its extending end and the C-shape buckle 12 are latched to fix to the bearing 11 in position;

an elastic member 2 (which could be a volute spring), one end being sleeved into predetermined hole 30 on the sectional axle 3 for the positioning, and the other end of the elastic member 2 presses against the flange B1 of the first engraved trunk B and has a pushing reaction force, and the end section is inserted into a hole B11 on the flange B1 for positioning (as shown in FIG. 3);

a sectional axle 3, being extended into the penetrating hole 10 of the retardation compartment 1, and the sidewall facing the penetrating hole 10 is serrated as teeth 3A which are engaged with the retardation gear set D to form a connective relationship with the retardation gear set D, and the other end of the sectional axle 3 is facing the first engraved trunk B and the second engraved trunk A, and the sidewall of such end has teeth 31 which are engaged with the teeth A1 in the hole edge of the inner side of the second engraved trunk A as a simultaneous moving parts, and the sectional axle 3 is sleeved into the outer surface of the motor axle S, and there is no connection of direct movement with each other. The end of the motor axle S is a non-circular latching end S1 (the latching end S1 of this embodiment of the present invention is set to be a hexagonal tooth, however the shape is not limited to hexagonal only);

a first engraved trunk B, having a hole B2, which can be sleeved onto the sectional axle 3, and the inner edge of the hole B2 is a smooth surface, therefore it has no direct movement connection with the sectional axle 3, and the external edge of the flange B1 of the first engraved trunk B has a brake plate B3 which can be in frictional contact with or detached from the preset frictional surface 13 on the retardation compartment 1.

Figure 4:
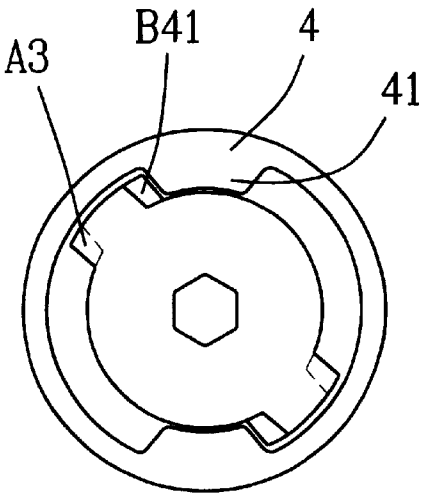
FIG. 4 shows the relative positions of the clutch base and the engraved trunks according to a preferred embodiment of the present invention.

In addition, a ringed base B4 at the top surface having a plurality of up and down (with different inclinations) inclined planes B40 is protruded from an end surface of the first engraved trunk B that faces the second engraved trunk A; on the corresponding outside wall of the ringed base B4 it has a protruded latching member B41;

a second engraved trunk A, inner teeth A1 are set on the inner edge of the center of the second engraved trunk A to face the sectional axle 3, the inner teeth A1 are engaged corresponding to the teeth 31 on the end side of the sectional axle 3, therefore the sectional axle 3 and the second engraved trunk A have direct movement connection with each other, and a set of C-shape buckle 12A latches the second engraved trunk A to the sectional axle 3 for the positioning in order to restrict and prevent the second engraved trunk A from being displaced. Further, an inclined plane A2 and a protruded latching member A3 of the second engraved trunk A are disposed at the position corresponding to the inclined plane B40 and protruded latching member of the ringed base B4 of the first engraved trunk B. However, there is a slight angle difference between the corresponding inclined plane A2 and the protruded latching member A3 at the position of the inclined plane B40 and the protruded latching member B41;

a clutch base 4, its center part facing the latching end S1 of the motor axle S has a latching hole 40 corresponsive to the shape of the latching end S1 of the motor axle S, such that the clutch base 4 being sleeved onto the latching end S1 of the motor axle S by means of the latching hole 40, and being rotated by the motor axle S. Further, the protruded latching members A3, B41 of the corresponding engraved trunks A, B in the clutch base 4 and the inner side of the clutch base 4 has a corresponding protruded trunk 41 as shown in FIG. 4 such that when the clutch base 4 is rotated by means of the motor axle S (no matter forward or reverse rotation), the protruded latching member A3 of the second engraved trunk A is pushed by the protruded trunk 41 at the inner side of the clutch base 4, so, the second engraved trunk A will rotate accordingly, and the sectional axle 3 will also rotate. Simultaneously, the clutch base 4 will immediately use its protruded trunk 41 to push the protruded latching member B41 of the first engraved trunk B, such that the first engraved trunk B will also rotate accordingly;

a bushing 5, being inserted onto the corresponding bushing base 42 of the clutch base 4, and the external side of the bushing 5 is restricted by the protruded member 60 at the inner side of the rear casing 6 of the retardation compartment 1, and the rear casing 6 of the retardation compartment 1 is coupled to the retardation compartment 1 for the positioning such that the rotation of the clutch base 4 attains the effect of stable transmission.

By means of the assembly of the foregoing components, the elastic member 2 is pressed, therefore it will exist a reaction force and a tendency for the brake plate B3 on the first engraved trunk B being pushed away from the frictional surface 13, but when the components are stalled, an appropriated whirling force can be installed between the first engraved trunk B and the elastic member 2 (i.e. after inserting an end of the elastic member 2 into the predetermined hole 30 of the sectional axle 3, the other end will be rotated and pressed slightly, and then is inserted into the hole B11 of the engraved trunk B for the positioning) such that a reverse whirling torque exists on the first engraved member B with respect to the elastic member 2, and a tendency to push the brake plate B3 of the first engraved trunk B towards the frictional surface 13, and the reverse whirling torque is larger than the pushing force. Therefore, when it sits still, the brake plate B3 of the first engraved member B is always near the frictional surface 13 and generates the friction. Under normal still condition, it is always in the braking status, which is shown in FIGS. 3 and 4. In FIG. 4, there is an angle difference between the protruded latching member A3 of the second engraved trunk A and the protruded latching member B41 of the first engraved trunk B due to their alignments, and the protruded trunk 41 does not press against the protruded latching members A3, B41. Therefore there is no pushing against each other.

Figure 6:
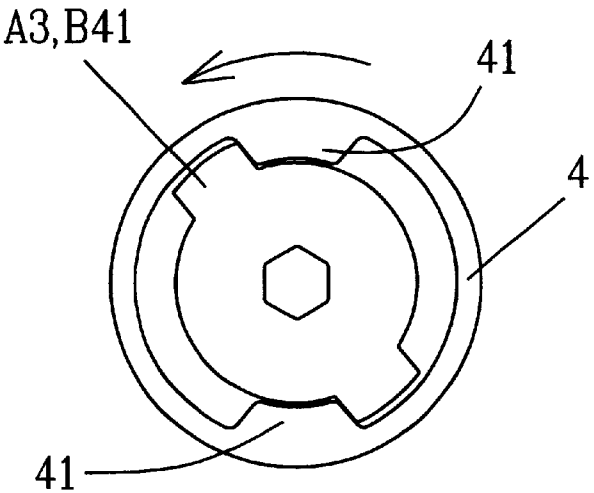
FIG. 6 shows the movement of the clutch base and the engraved trunks of a preferred embodiment of the present invention when the motor is moving forward.
Figure 5:
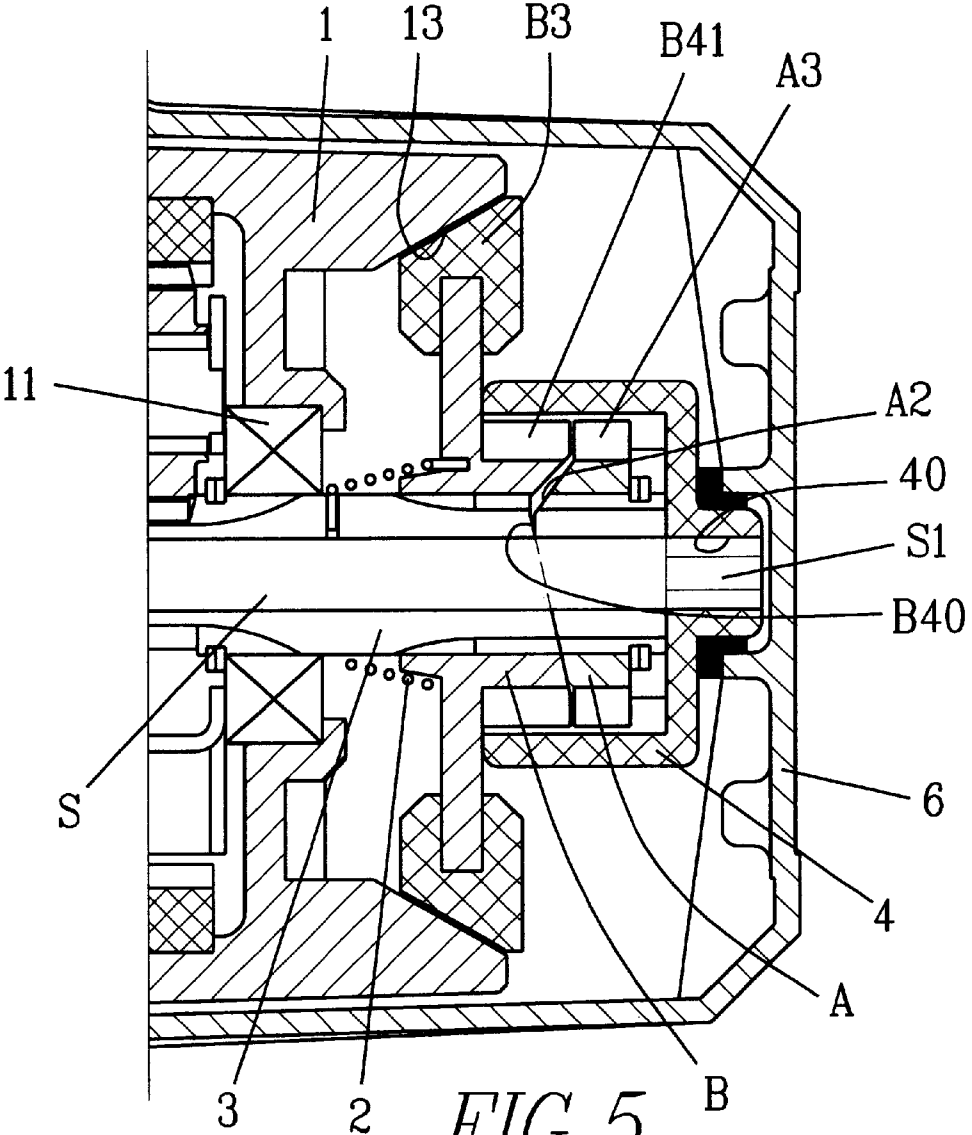
FIG. 5 shows the cross-sectional diagram of the motor according to a preferred embodiment of the present invention when the motor is moving forward.
Figure 8:
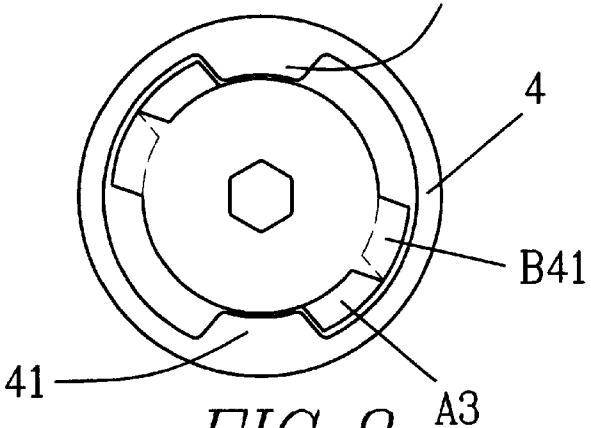
FIG. 8 shows the movement of the clutch base and the engraved trunks a preferred embodiment of the present invention when the motor is stopped.
Figure 7:
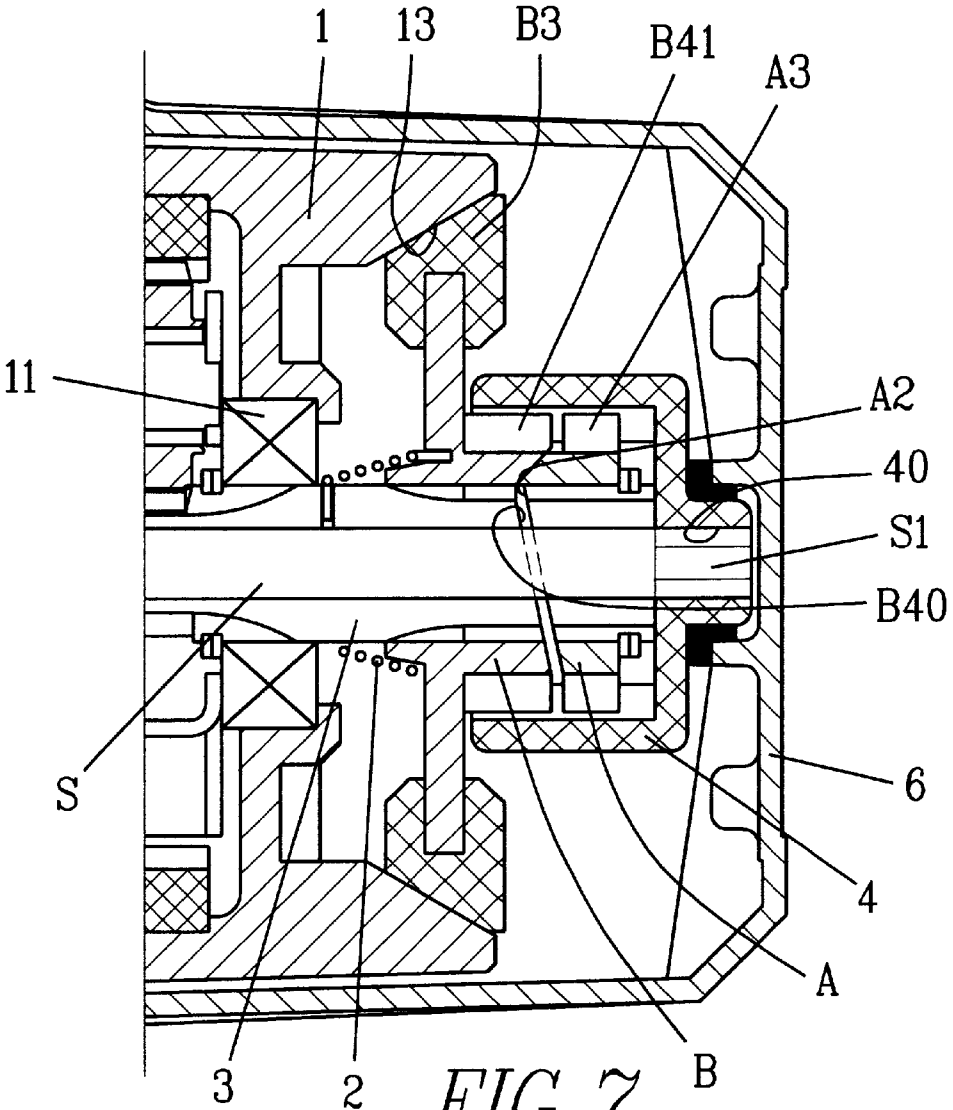
FIG. 7 shows the cross-sectional diagram of a preferred embodiment of the present invention when the motor is stopped.

When the user is loading heavy stuff, the user presses the forward button in order to let the motor rotate and bring its axle S into rotation, and then it will immediately bring the clutch base 4 into rotation as well. In a split second, the protruded trunk 41 of the clutch base 4 pushes against the protruded latching member A3 of the second engraved trunk A and the protruded member B41 of the first 15 engraved trunk B such that both engraved trunks A and B are rotated simultaneously (as shown in FIG. 6). Then the engraved member A is rotated synchronously with the sectional axle 3, and the sectional axle will be engaged with the retardation gear set D. Therefore, it can transmit the rotation to the wire cable reel to collect the wire cable and lift heavy substance. In the meantime, the first engraved trunk B is also brought into rotation such that the angle difference between the engraved trunks A, B disappears, and the less-inclined surface of the first engraved trunk B will be proximate to the less-inclined surface of the second engraved trunk A (as shown in FIG. 5), and the rotation force is larger than the reverse torque exerted on the first engraved trunk B. In addition, the reverse pushing force of the elastic member 2 makes the first engraved trunk B to be proximate to the right side (as shown in FIG. 5), therefore the brake plate B3 detaching from the contact of the frictional surface 13 can successfully lift the heavy substance. When the motive force stops, the motor axle S and the clutch base 4 will stop immediately, and thus the protruded trunk 41 of the clutch base 4 will stop pushing the protruded latching members A3 and B41. However, the torque generated by the gravitational force of the heavy substance will bring the wire of the wire cable reel back into position, and the transmission by the retardation gear set D on the sectional axle 3 and the second engraved trunk A will rotate back in position. Actually, the second engraved trunk A rotates back in position for a very short distance, and then it will stop. In a split second, the angle difference between engraved trunks B and A will be produced again (as shown in FIG. 8). In such a short time, the more-inclined plane A2 of the second engraved trunk A is pushed to the more-inclined plane B40 of the first engraved trunk B. In addition, a reverse torque is exerted on the first engraved trunk B by the elastic member 2, and thus the first engraved trunk B has to shift to the left (as shown in FIG. 7), and spontaneously it produces a braking effect such that the brake plate B3 and the frictional surface 13 tightly attach to each other. The larger the torque of the heavy substance, the larger is the force pushed by the second engraved trunk A onto the first engraved trunk B, and hence the larger is the braking force.

Figure 10:
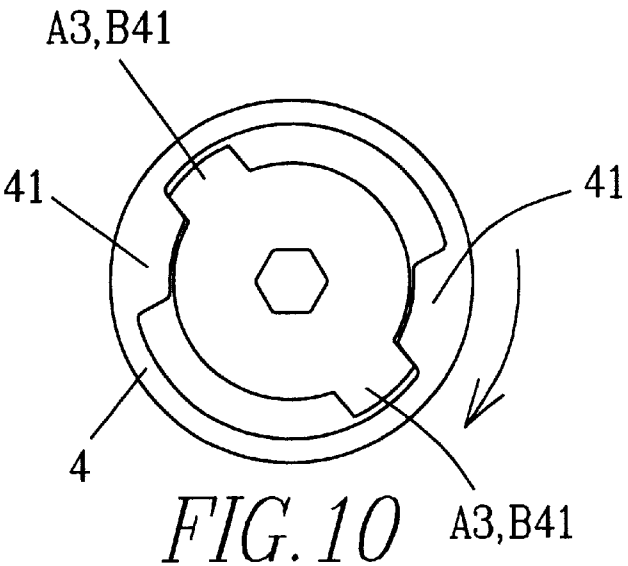
FIG. 10 shows the movement of the clutch base and the engraved trunks a preferred embodiment of the present invention when the motor is reversing.
Figure 9:
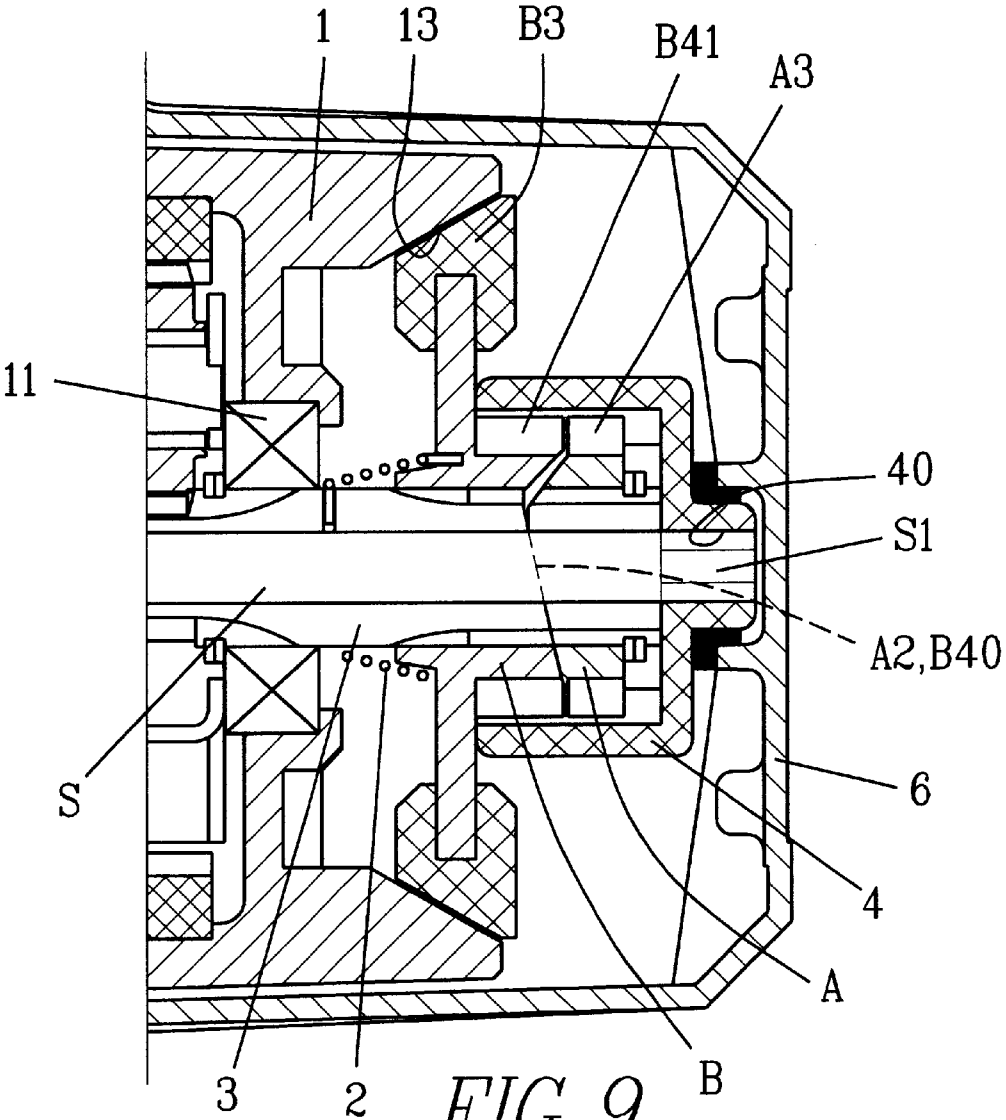
FIG. 9 shows the cross-sectional diagram of a preferred embodiment of the present invention when the motor is reversing.

The above-mentioned situation shows the braking action from the user lifts the heavy substance until it stops. Another commonly used situation is when the heavy substance is unloaded from the high position until it stops at a low position. In such process, when the user lifts the heavy substance on the hook at the end of a wire to suspend the heavy substance, it will produce the braking effects as depicted in FIGS. 7 and 8, and the user operates the motor to rotate the motor axle S and the clutch base 4 in reverse direction. In a split second, the protruded trunk 41 in the clutch base 4 will push the protruded latching member B41 of the first engraved trunk B and then push the protruded latching member A3 of the second engraved member A (as shown in FIG. 10) and it eliminates the angle difference between the first and second engraved trunks B and A, and the less-inclined surface of the first engraved trunk B will be proximate to that of the second engraved trunk A (as shown in FIG. 9). The brake plate B3 of the first engraved trunk B will detach from the contact of the frictional surface 13 and successfully unload the heavy substance from a high position. Please compare the figures of FIGS. 5 and 9 for the lifting or unloading a heavy substance, the first engraved trunk B slightly shift to the right, and the braking effect stops, it will immediately produce the braking effect as shown in FIG. 7. Furthermore, it has a braking effect even when there is no suspending heavy substance on the wire or no motive force as shown in FIG. 3.

It is known from the above description, the braking effect exists once the device is assembled, and once the motor is started (regardless of the forward rotation or the reverse rotation), the braking effect is stopped. When the motive force is stopped suddenly or during power failure, the brake will be in effect immediately. The heavier the substance, the larger is the braking effect. It ensures the safety and convenience of using such device.

Figure 11:
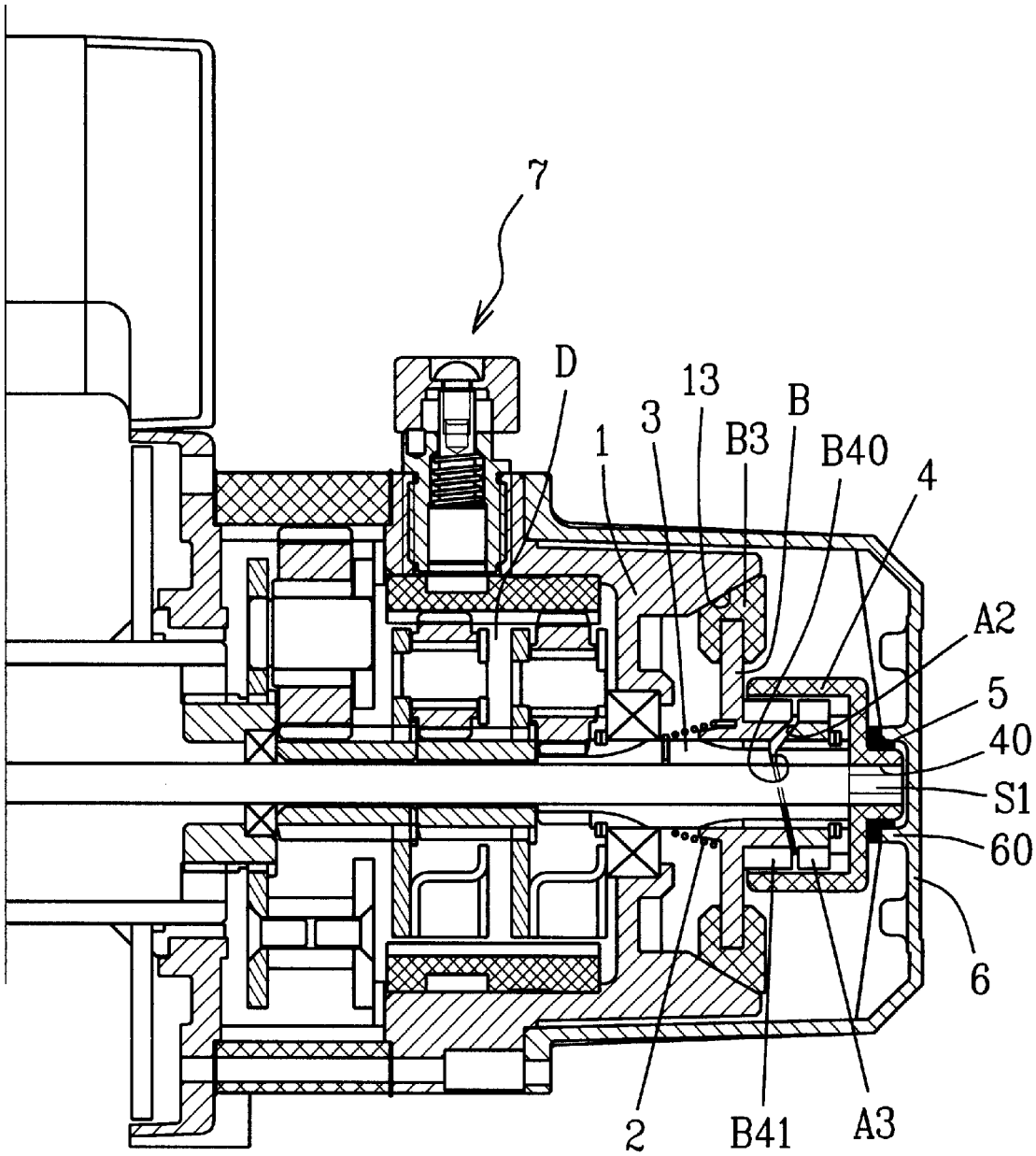
FIG. 11 shows cross-sectional diagram of a preferred embodiment of the present invention when the cable wire is placed manually by pulling up the clutch mechanism.

In addition, we can install a manually operated clutch mechanism 7 to the retardation compartment 1 of the present embodiment of the invention (please refer to FIGS. 2 and 12). When the user desires to operate the wire cable manually (i.e. the user does not rely on the motor for releasing the wire cable), the operator can use such manual operated clutch mechanism 7 for the control to pull the handle of the clutch for the positioning and disable the effect of rotary force between the gear mechanism in the retardation compartment 1 and the sectional axle 3 (as shown in FIG. 11) such that the gear mechanism in the retardation compartment 1 will be idle rotation and the rotary force will not be transmitted to the sectional axle 3. Therefore, the wire cable reel will not be controlled by the braking device, and can easily pull the wire cable out to attain the purpose of releasing the wire cable manually. When the wire cable is to be rotated back into the reel (when lifting heavy substance), the user only needs to release the handle of the clutch.

In summation of the above description, when the braking device of the present invention is in use, it definitely has a safe braking effect because once the motive force disappears (such as pressing the stop button for the motor or during power failure), the device will immediately produce a braking effect (as shown in FIG. 7) due to the reaction in the reverse gravitation of the heavy load of the substance on the wheel. Therefore, it is absolutely safe to use such device. When the device according to the present invention is not in use, it is always in the braking status, which the device is a safe mechanical brake and a safe operating environment for a motive force winch. It enhances the traditional braking device and improves the shorting comings of the prior art.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A braking device for a motive winch, comprising:

a retardation compartment being disposed on the motive winch, and having a penetrating hole in a middle thereof adapted for allowing a motor axle to pass therethrough, and a sectional axle to extend thereinto, the sectional axle extending into the penetrating hole of the retardation compartment, and a sidewall thereof at an end facing the penetrating hole has teeth engaged to a retardation gear set for engagement to a transmission device, and a sidewall on another end of the sectional axle has teeth which can be engaged with inner teeth of a second engraved trunk for the transmission device;

an elastic member being sleeved into the sectional axle, the sectional axle including a hole disposed thereon for receiving an end section of the elastic member;

a first engraved trunk having a hole on the sectional axle facing the elastic member, and an external edge thereof includes a brake plate and the side of the first engraved trunk facing the elastic member has a hole for receiving the insertion of an end of the elastic member for positioning, when the elastic member is installed the first engraved trunk slightly rotates and presses with respect to the elastic member such that the first engraved trunk with respect to the elastic member can have whirling force sufficient to push the brake plate of the first engraved trunk, and the brake plate contacts a frictional surface being set on the retardation compartment and a ringed base being disposed on a top surface thereof with a plurality of up and down inclined planes outwardly protruded from the end of the elastic member facing backwards to the first engraved trunk, and an external wall of the ringed base has a pair of outwardly protruded latching members;

a second engraved trunk having a hole in a middle thereof and inner teeth being engaged with the corresponding teeth of the sectional axle, the inclined plane and a protruded latching member of the first engraved member facing the second engraved member also have a corresponding inclined surface and the protruded latching member;

a clutch base, a latching hole corresponding to the latching end of the motor axle disposed in and facing the middle of the latching end of the motor axle, and the inner side of the clutch base has a pair of protruded trunks to push the protruded latching members of the first and second engraved trunks; and a bushing being inserted onto a corresponding bushing base of the clutch base, and the external side of the bushing is restricted by the protruded member at an inner side of a rear casing of the retardation compartment, and the rear casing of the retardation compartment is coupled to the retardation compartment for the positioning thereof such that when a motor secured to the motor axle rotates, the motor axle brings the clutch base and the second engraved trunk and the first engraved trunk into rotation, and the brake plate of the first engraved trunk detaches from the frictional surface of the retardation compartment, which stops the braking effect and in turn starts the rotation of the wire cable reel by the indirect transmission of the motor; and when the motive force is stopped, the load of the heavy substance suspended on a wire cable thereof produces a reverse pulling force, such that the first engraved trunk produces a reverse pushing force to push the brake plate of the first engraved trunk to press against the frictional surface of the retardation compartment, and produce a prompt braking effect.

* * * * *